US006120334A

United States Patent [19]

Timsit et al.

[11] Patent Number: 6,120,334

[45] Date of Patent: Sep. 19, 2000

[54] ELECTRICAL CONNECTOR FOR PIERCING THE INSULATION OF AN INSULATED CABLE

[76] Inventors: Roland Sion Timsit, 467 Woburn Avenue, North York, Ontario, Canada, M5M 1L6; Albert Renaud Perrin, 757 Dillman Avenue, Newmarket, Ontario, Canada, L3X 2K3

[21] Appl. No.: 09/289,353

[22] Filed: Apr. 9, 1999

Related U.S. Application Data

[60] Provisional application No. 60/104,322, Oct. 15, 1999.

[51] Int. Cl.[7] ..... H01R 11/01

[52] U.S. Cl. ..... 439/783; 439/863

[58] Field of Search ..... 439/783, 863, 439/393, 417, 435

[56] References Cited

U.S. PATENT DOCUMENTS

| | | | |
|---|---|---|---|
| 1,801,277 | 4/1931 | Kelley | 439/807 |
| 3,329,928 | 7/1967 | Broske | 439/783 |
| 3,588,791 | 6/1971 | Polidori | 439/783 |
| 3,811,105 | 5/1974 | Gerhard | 439/783 |
| 4,415,222 | 11/1983 | Polidori | 439/783 |
| 5,006,081 | 4/1991 | Counsel et al. | 439/783 |
| 5,145,420 | 9/1992 | Counsel et al. | 439/783 |
| 5,151,560 | 9/1992 | Kreinberg et al. | 174/94 R |
| 5,567,186 | 10/1996 | Diniz et al. | 439/783 |
| 5,830,019 | 11/1998 | Chadbourne et al. | 439/783 |
| 5,842,893 | 12/1998 | De Keyser | 439/783 |
| 5,911,604 | 6/1999 | Chadbourne | 439/783 |
| 5,916,001 | 6/1999 | Chadbourne | 439/783 |

*Primary Examiner*—T. C. Patel

[57] ABSTRACT

The invention is directed to an electrical connector having a C-shaped member with two ears with arcuate inner surfaces. At least one of the arcuate inner surfaces has teeth extending inwardly with at least one of the teeth having a plastic cap disposed on it. A wedge is designed to be secured within the C-shaped member and terminated two cables therein. The wedge has two sides which cooperate with the arcuate inner surfaces to terminate the cables. At least one of the sides has a blade extending outwardly therefrom.

2 Claims, 9 Drawing Sheets

ELECTRICAL CONNECTOR FOR PIERCING THE INSULATION OF AN INSULATED CABLE

This application claims the benefit of U.S. Provisional application Ser. No. 60/104,322, filed Oct. 15, 1999.

FIELD OF THE INVENTION

The present invention relates to the field of electrical connectors, and more particularly, to wedge connectors.

BACKGROUND OF THE INVENTION

Electrical connectors of the type having a C-shaped body member having converging channels and a complementary wedge member have been known conventionally for many years. One such connector is disclosed in U.S. Pat. No. 5,145,420 ('420), which is herein incorporated by reference. Other similar connectors are disclosed in U.S. Pat. Nos. 1,801,277; 3,329,928; 4,415,222; 5,006,081; 5,151,560; 5,567,186; 5,830,019; and 5,842,893, as well as in document EP 0810687A1. Basically, as disclosed in the '420 patent, two uninsulated cables are electrically and mechanically connected by being pressed into and against arcuate curved surfaces or channels provided in a C-shaped body member by a wedge being driven longitudinally into the C-shaped body member between the cables. These known wedge connectors have been successfully used in the power utility industry for power cables and have C-members which are massive enough to exert a resilient compressive force on the cables trapped in the channels by the wedge thereof.

U.S. Pat. No. 5,145,420 ('420) discloses an electrical connector for connecting two uninsulated cables together. The C-shaped member and the wedge provide a compressive force against the two opposing cables to both mechanically and electrically connect the two uninsulated cables together. A good electrical connection is formed by the wiping action between the wedge and the cables during the insertion of the wedge into the C-shaped member.

It would be desirable to have a wedge type connector which can be terminated to at least one insulated cable and to provide a good electrical connection therebetween with minimal damage to the conductors within the cables. Furthermore, it would be desirable to have wedge type connectors which can be installed on a live insulated conductor to connect and energize an electrical load.

SUMMARY OF THE INVENTION

The invention is directed to an electrical connector having a C-shaped member with two ears with arcuate inner surfaces. At least one of the arcuate inner surfaces has teeth extending inwardly. A wedge is designed to be secured within the C-shaped member and terminating the two cables therein. The wedge has two sides which cooperate with the arcuate inner surfaces to terminate the cables. At least one of the sides has a blade extending outwardly therefrom.

The invention is further directed to an electrical connector comprising a C-shaped member having two ears with arcuate inner surfaces to receive cables therein. A wedge is designed to be secured with the C-shaped member and terminated to the cables. The wedge has two sides which cooperate with the arcuate inner surfaces to terminate the cables. An insert has two arcuate extensions extending from a central member. The arcuate extensions are designed to be received between the cables and the wedge. At least one of the arcuate extensions has teeth extending outwardly therefrom to cut or pierce through insulation on at least one of the cables.

The invention is further directed to an electrical connector comprising a C-shaped member having two ears with arcuate inner surfaces. At least one of the arcuate inner surfaces has teeth extending inwardly. At least one of the teeth has a plastic cap disposed thereover. A wedge is designed to be secured within the C-shaped member and terminated to cables therein. The wedge has two sides which cooperate with the arcuate inner surfaces to terminate the cables.

BRIEF DESCRIPTION OF THE DRAWINGS

Embodiments of the present invention will now be

DETAILED DESCRIPTION OF THE PREFERRED EMBODIMENTS

Figure 1:
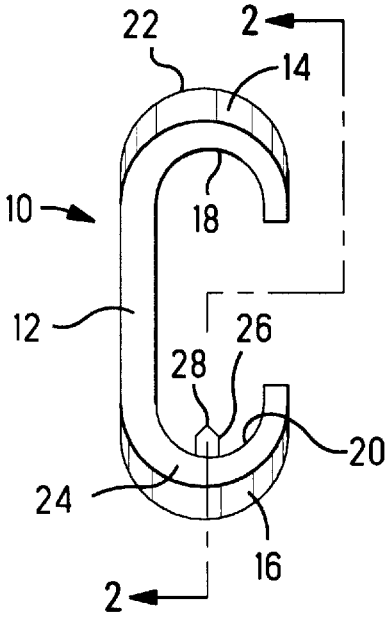
FIG. 1 is an end view of the C-shaped member of the present invention.
Figure 2:
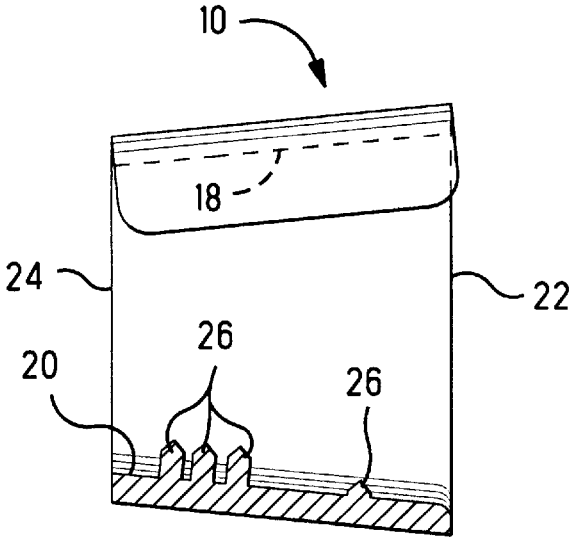
FIG. 2 is a partial front cross-sectional of the C-member.

FIGS. 1 and 2 illustrate a C-shaped member 10 which is used in conjunction with one of the wedges shown in FIGS.

3 through 16 in order to provide an electrical connector for connecting two cables together. A C-shaped member 10 includes a flat section 12 extending to opposed ears 14, 16 having arcuate inner surfaces 18, 20 defining outer peripheries of wire channels and decreasing linearly in width from a forward end 22 to a rearward end 24. The C-shaped member 10 is formed from an electrically conductive material such as copper, a copper alloy, aluminum or an aluminum alloy.

At least one of the arcuate channels 18, 20 has a series of teeth 26 extending from the interior surface of the arcuate inner surfaces 18, 20 in toward the wire channels. The teeth 26 extend from the arcuate inner surfaces 18, 20 to a pointed tip 28 on each of the teeth 26. The teeth 26, shown in FIGS. 1 and 2, are illustrated as being arranged in one row from the forward end 22 to the rearward end 24, however, it is to be understood that the teeth 26 may be arranged in other configurations such as in two rows, staggered rows, or multiple rows. The teeth 26 may also have a shape different than that shown in FIGS. 1 and 2, such as sawtooth or M-shaped.

The teeth 26 may be disposed in either one or both of the arcuate inner surfaces 18, 20. The teeth 26 are shown having a higher height toward the rearward end 24 of the C-shaped member 10 than the teeth 26 toward the forward end 22, the purpose of which will be explained below. While the C-shaped member 10 shown in FIG. 2 shows three teeth 26 disposed near the rearward end 24 and one tooth 26 disposed near the forward end 22, it is to be understood that there may be many more teeth between the first and the last, and furthermore that the teeth 26 may become progressively smaller from the rearward end toward the forward end.

FIGS. 3 through 6 show one embodiment of the wedge of the present invention. The wedge 40 can be formed from an electrically conductive material such as copper, a copper alloy, aluminum, or an aluminum alloy. The wedge 40 has a forward end 42 and a rearward end 44, with the width of the wedge decreasing from the forward end 42 to the rearward end 44.

Along either side 46 of the wedge are two blade members 48. The blade members 48 each have elongated tips 50 and have points 52 along the rearward end of the wedge 40. The points 52 act as leading edges or cutting or piercing edges. The elongated tips 50 of the blade members 48 extend along both sides 46. The elongated tips 50 may be chamfered.

The wedge 40, shown in FIGS. 3 through 6, cooperates with a C-shaped member 10, such as shown in FIGS. 1 and 2, wherein the teeth 26 are disposed in both arcuate inner surfaces 18, 20. The C-shaped member 10 and the wedge 40 terminate two insulated cables together and provide electrical conductivity therebetween. The insulated cables contain conductors therein which are covered with a dielectric sheathing.

In operation, two insulated cables are seated within the C-shaped member 10 along the arcuate inner surfaces 18, 20. The teeth 26 are pressed against the surface of the insulation on the cable. The rearward end 44 of the wedge 40 is inserted into the C-shaped member 10 between the two insulated cables. The wedge 40 is then fully seated within the C-shaped member 10 using standard techniques, such as by the application of an explosively fired tool or by the application of some other force in order to drive the wedge 40 fully into the C-shaped member 10.

As the wedge 40 is driven into the C-shaped member 10, the insulated wires are pushed outwardly against the arcuate surfaces 18, 20 of the C-shaped member so that the teeth 26 cut through the insulation thereby forming electrical contact and establish an electrical path between the conductors of the cables underneath the insulated sheathing. Also, as the wedge 40 is driven into the C-shaped member 10, the blade members 48, in particular the elongated tips 50 slide along the insulation of cable cutting or piercing into and through the insulation on the cables to provide an electrical connection with the conductors within the insulated cable. During insertion of the wedge 40, the points 52 cut into the insulation on the cable. The insulation is then penetrated by the remaining length of the blades 48.

The practice of the invention can be used to terminate or electrically connect one insulated cable with another insulated cable, or alternatively, the invention can also be used to terminate one insulated cable with an uninsulated cable.

FIGS. 7 through 11 show a second embodiment of the invention, that is, a wedge member 140 which can be used to terminate an insulated cable with an uninsulated cable. Wedge member 140 has a forward end 142 and a rearward end 144 and sides 146. Along one side 146 are a pair of blade members 148 each having elongated tips 150. Toward the rearward end 144 of the wedge 140, the blade members 148 have sloped surfaces which come to a point 152 to provide a good cutting or piercing action against insulation of the cable. Along the opposite side 146 of the wedge 140 there is an arcuate shaped channel 154 which is conventionally used in other wedge connectors.

The C-shaped member 10 that is used with this wedge member 140 has teeth 26 disposed along only one arcuate inner surface 20 of the C-shaped member 10. The opposite arcuate inner surface 18 of C-shaped member 10 is preferably smooth or has small serrations to cut through an outer oxide layer or other contamination on the uninsulated cable for which this invention finds application. The insulated cable is received along the arcuate inner surface 20 having the teeth 26 and the uninsulated cable is received along the opposite side of the C-shaped member along the smooth or serrated arcuate inner surface 18.

The wedge 140 is inserted into the C-shaped member 10 with the blade members 148 engaging the insulated cable placed on arcuate inner surface 20. As the wedge 140 is inserted into the C-shaped member 10 in a typical manner, the arcuate channel 154 of the wedge 140 scrapes against the surface of the uninsulated wire thereby forming a good electrical connection with the uninsulated cables. The blade members 148 slide along the insulation on the insulated cable and cut through the insulation, thereby, forming an electrical connection with the conductors in the insulated cable. At the same time, the teeth 26 of the C-shaped member 10 are driven through the insulation into contact with the conductors of the insulated cable.

The wedge 240, shown in FIGS. 12 through 16, is an alternative embodiment, that is, blade member 248. The wedge 240 has a forward end 242 and a rearward end 244 and two sides 246. Along one side 246 is an arcuate channel 254 which will engage an uninsulated wire. Along the opposite side 246 is a single blade member 248. The blade member 248 has a pointed end 250 directed toward the rearward end 244 of the wedge member 240 and elongated edge 248 to engage and pierce through the insulation on an insulated cable during termination. The wedge member 240 will be terminated to a C-shape member 10 in a similar manner as already been described.

The C-shaped member 10 and the wedges of the different embodiments of the present invention can be designed in a variety of configurations depending on the specific application. For example, the C-shaped member and wedge can be arranged for terminating through two insulated cables, or similarly, for one insulated and one uninsulated cable as has already been described. Furthermore, for example, the C-shaped member 10 could be designed having two rows of teeth 26, and opposite those two rows, the wedge having two blade members, as is shown in FIGS. 3 through 6. The C-shaped member 10 can also be designed with one row of teeth and the wedge member having one blade, as is shown in FIGS. 12 through 16. Other combinations of these arrangements may also be desirable depending on the specific application.

Figure 17:
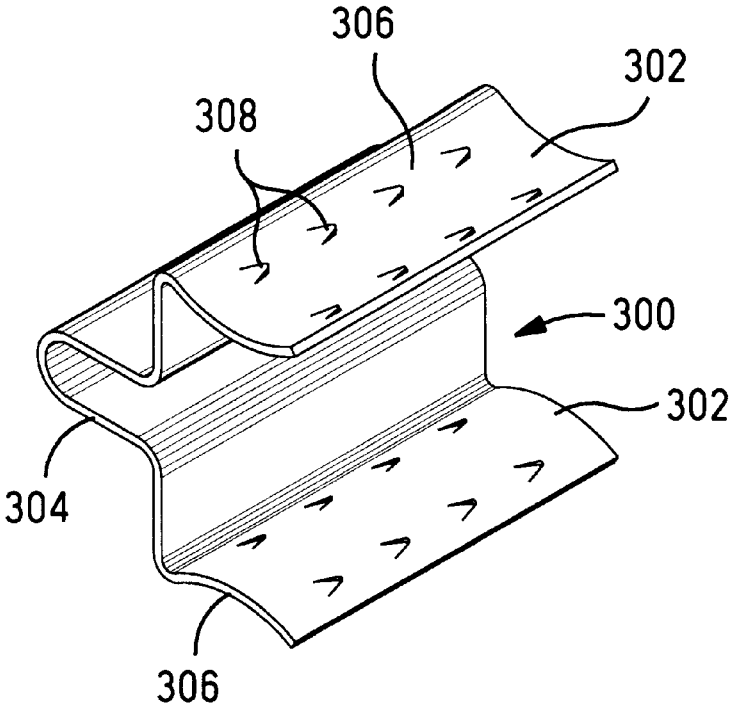
FIG. 17 is a perspective view of an electrically conductive piercing insert of the present invention.
Figure 18:
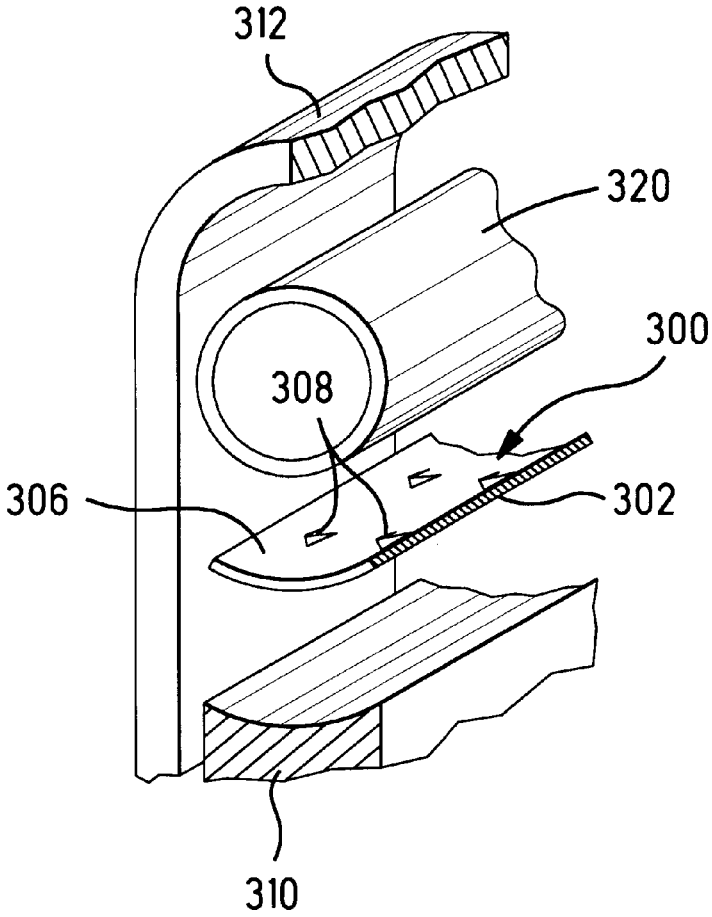
FIG. 18 is a partial cross sectional view showing the arrangement of the insert between the C-shaped member and the wedge.
Figure 19:
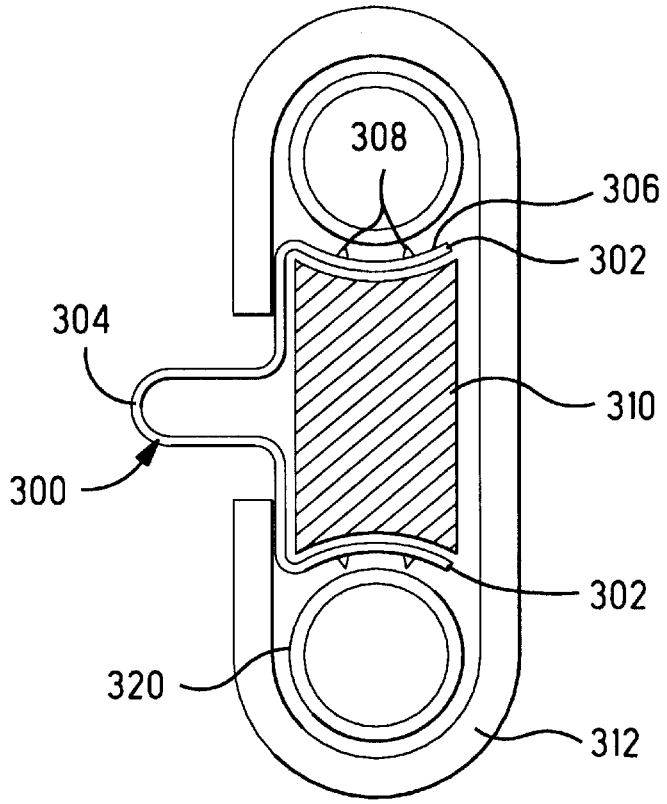
FIG. 19 is a partial cross sectional view showing the electrical connector and the insert of FIG. 17.

FIGS. 17–19 show an alternative method for terminating an insulated cable to either another insulated cable or an uninsulated cable. FIG. 17 shows an insert 300 which is to be received in a standard C-shaped member and wedge connector. The insert 300 is typically made from an electrically conductive material known in the art and has a central portion 304 connecting two arcuate extensions 302. The arcuate extensions 302 each have curved wire receiving surfaces 306 with teeth 308 extending outwardly. The arcuate extensions 302 are received between the wedge member 310 and the C-shaped member 312, as is shown in FIGS. 18 and 19.

In practice, insulated cables 320 are positioned within the C-shaped member 312 in a manner known in the art. The insert 300 is then positioned such that the curved wire receiving surfaces 306 are received against the cables 320. The wedge member 310 is then driven into the C-shaped member 312 pushing the arcuate extensions 302 outwardly so that the teeth 308 are forced through the insulation of the insulated cable 320, thereby forming an electrical connection with the conductors of the cable 320.

The insert 300 can be designed with teeth 308 along both curved wire receiving surfaces 306, or alternatively, the insert 300 can be designed with teeth 308 along only one curved wire receiving surface 306. The opposite curved wire receiving surface 306 is preferably smooth to form an electrical connection with an uninsulated cable.

The insulation piercing connectors described above allow connections to be made wherein one of the cables being terminated is live, that is, it has an associated voltage and is capable of carrying current. Also, it is possible to employ the insulation piercing connectors of the present invention described above to connect an electrical load to a live system.

One problem that is associated with terminating a live cable is the arcing that can occur when the conductors come into close proximity with each other. This arcing can cause burning of the material near the arcing sites. Another problem is possible accidental contact of the connector with the live, insulated conductor. This situation can create an electrical shock hazard.

Figure 20:
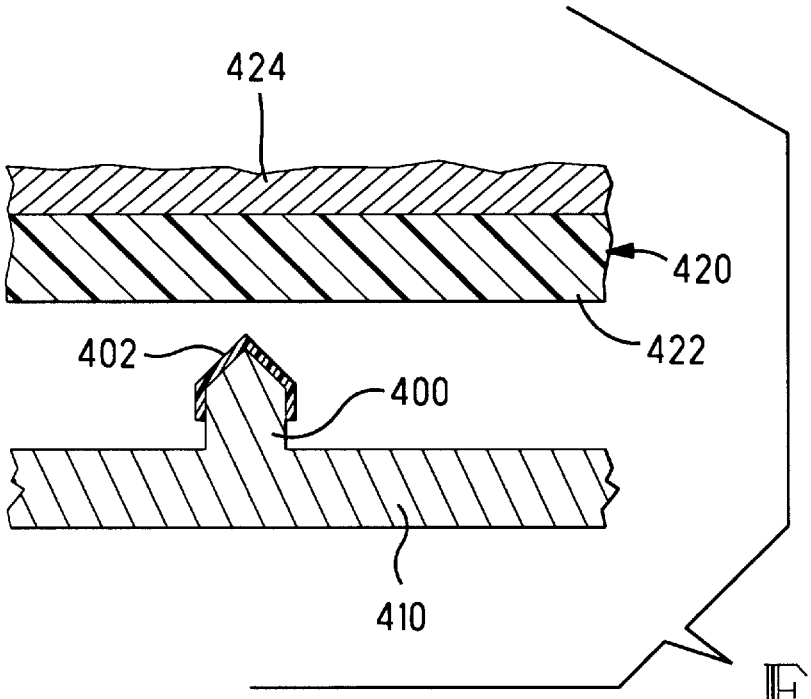
FIG. 20 is a cross sectional view showing a tooth and a plastic cap.
Figure 21:
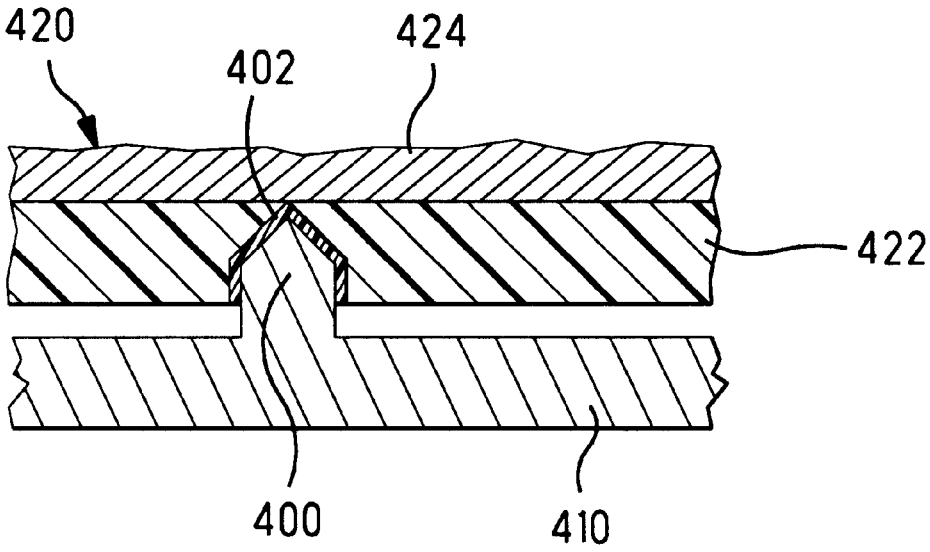
FIG. 21 is a view similar to claim 20 showing the connector partially terminated; and connector partially terminated.
Figure 22:
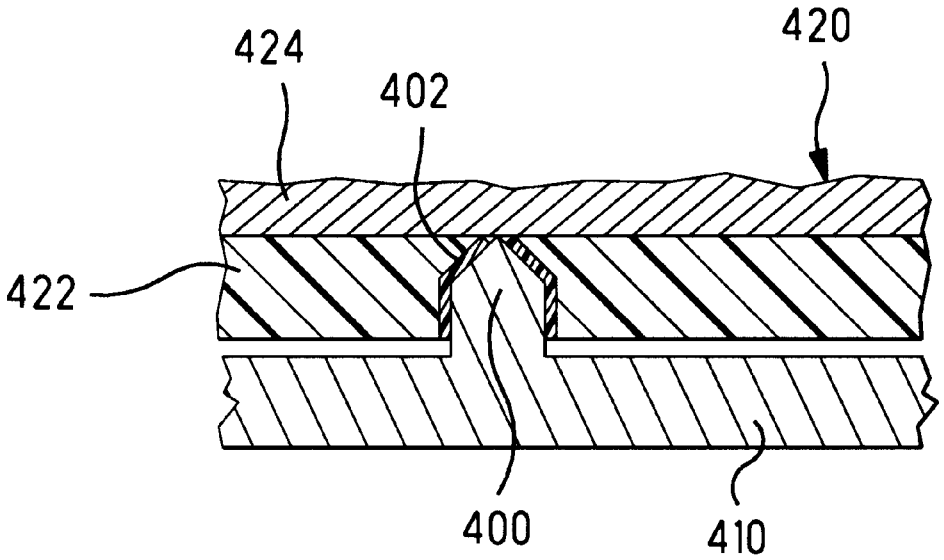
FIG. 22 shows the connector wherein the tooth has made electrical contact.

One solution to assist insulation piercing associated with making live connections is shown in FIGS. 20–22. In this embodiment at least one of teeth 400, which can be either a part of the C-shaped member or the insert described above, generally shown in FIGS. 20–22 as 410, has a plastic cap 402 disposed over the tip of the tooth 400. It is only necessary to provide a plastic cap 402 over one of the teeth 400. The tooth 400 that would have the plastic cap 402 would be the tooth 400 which is closest to the forward end of the C-shaped member of the insert 410, or alternatively, the tooth 400 which is longest and would make electrical contact first upon termination.

As the tooth 400 is inserted and pushed into the insulated cable 420 during termination of the wedge 410 into the associated C-shaped member, the plastic cap 402 pushes through the insulation 422 and the plastic cap 402 ensures that the tooth 400 does not come into contact with the conductors 424 of the insulated cable 420. The final termination can be accomplished using an explosively fired tool as is known in the art, and the operator can perform this operation from a distance without touching the connector. Alternate tools may also be applicable to this task.

During the final termination, the plastic cap 402 will be displaced allowing the tooth 400 to come into contact with the conductor and allow commoning, that is, electrical connection between the cable and the connector. Because the operator can perform the final termination from a distance, he/she is protected from the heat generated by the electrical connection and from subsequent voltage provided to the connector. The tooth 400 can be designed to act as a sacrificial tooth in that it may be burned away during the termination. However, the effect will be that the conductors and the connector will be at the same voltage and the other teeth will be able to make electrical connection without arcing.

The practice of the present invention provides good electrical contact with the electrical conductor and comprises still further embodiments of various wedges that may be further described with reference to FIGS. 23–27.

Figure 3:
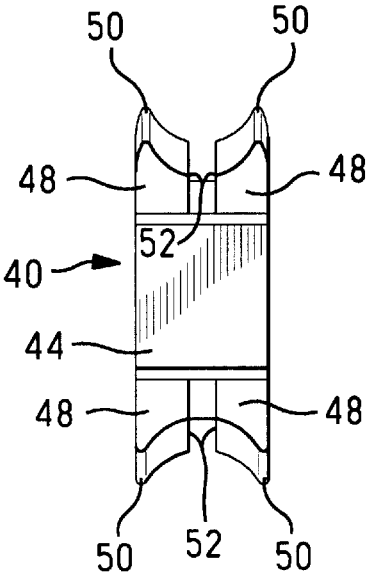
FIG. 3 is an end view of the wedge of the present invention.
Figure 4:
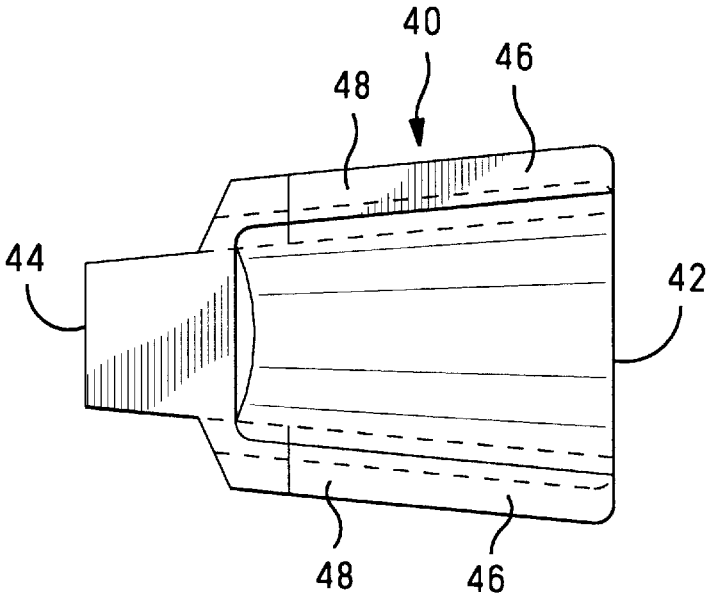
FIG. 4 is a front view of the wedge.
Figure 6:
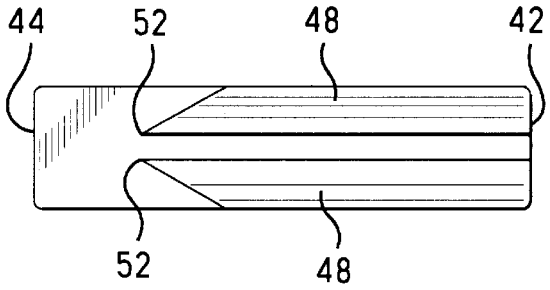
FIG. 6 is a side view of the wedge showing the blades.
Figure 7:
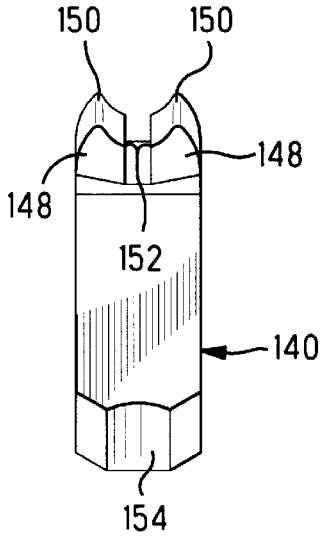
FIG. 7 is an end view of an alternative embodiment of the wedge.
Figure 8:
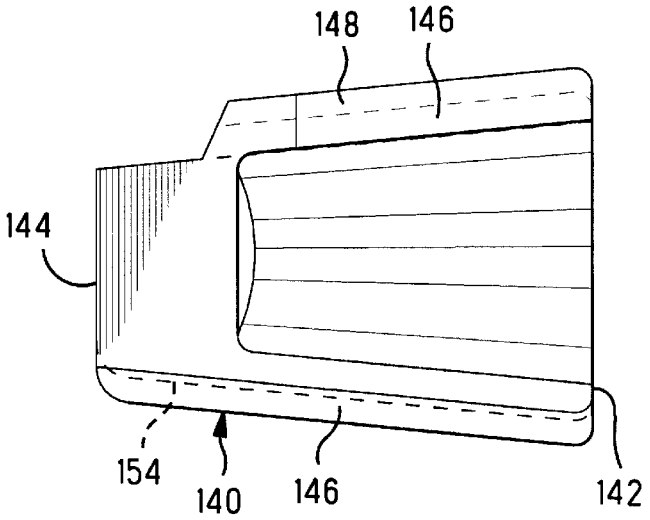
FIG. 8 is a front view of the wedge of FIG. 7.
Figure 12:
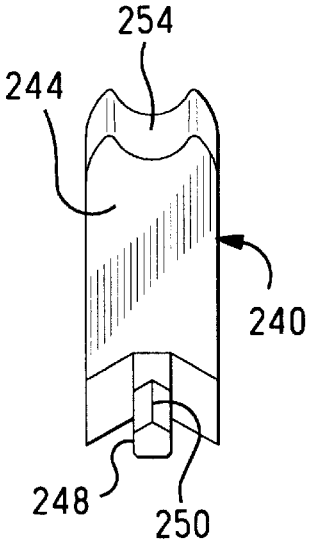
FIG. 12 is an end view of a third alternative embodiment of the present invention.
Figure 13:
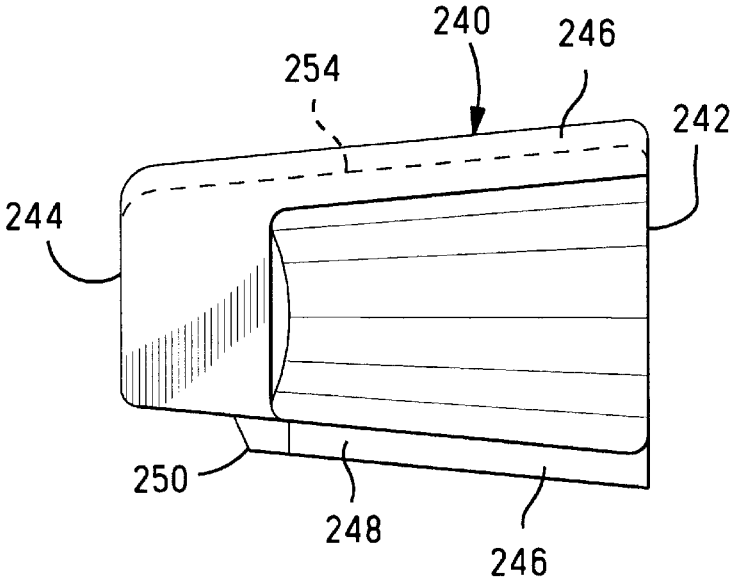
FIG. 13 is a front view of the wedge of FIG. 12.
Figure 23:
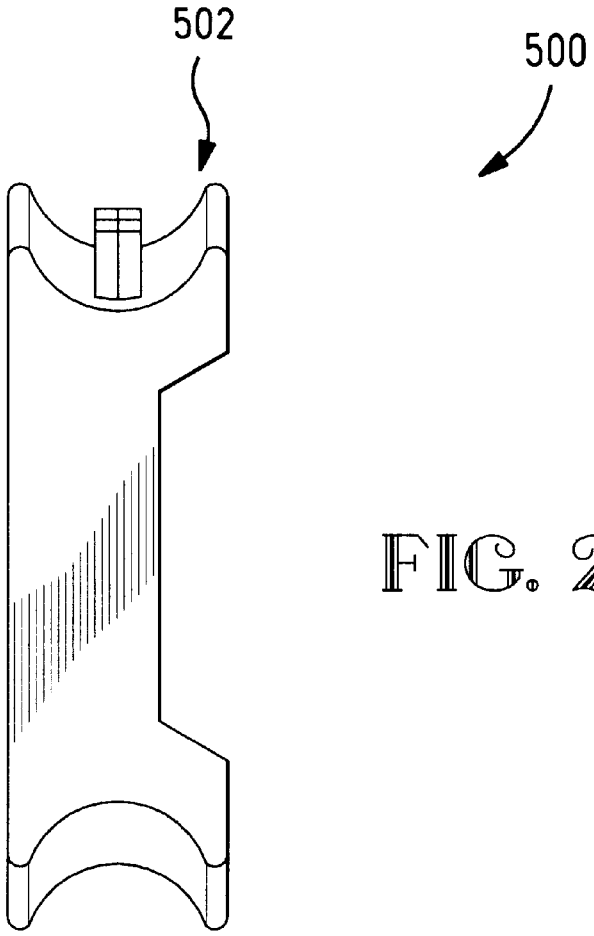
FIG. 23 is an end view of another embodiment of the wedge of the present invention.

FIG. 23 shows another embodiment that is, a wedge 500 having features similar to those previously described with reference to FIGS. 3, 7 and 12, but having a cluster 502 of multiple blades 504, 506 and 508 that are shown in the top view FIG. 24 of FIG. 23.

Figure 24:
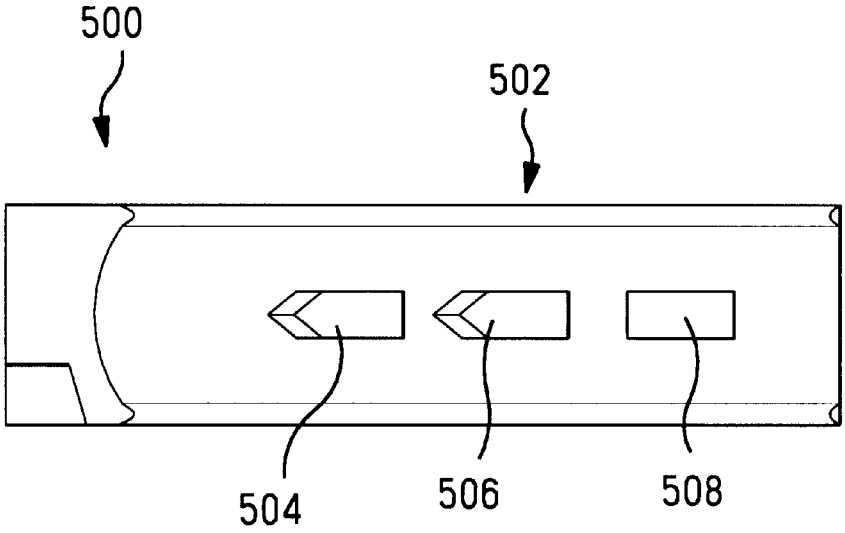
FIG. 24 is a top view of the wedge of FIG. 23 showing the multiple blades of the wedge.

As seen in FIG. 24, the cluster 502 may include sharp leading edges such as those of blades 504 and 506 for additional slitting of the insulation, or blunt leading edges such as that of blade 508 that can scrape away insulation remaining after the slitting action. The combined effect of these blades 504, 506 and 508 is to maximize the length of the contact of the cluster 502 with the conductors within the insulated cables. The arcuate shape on which the blades 504, 506 and 508 are embedded is intended, as with a conventional wedge, to seat against the curved surfaces of the conductor.

Figure 25:
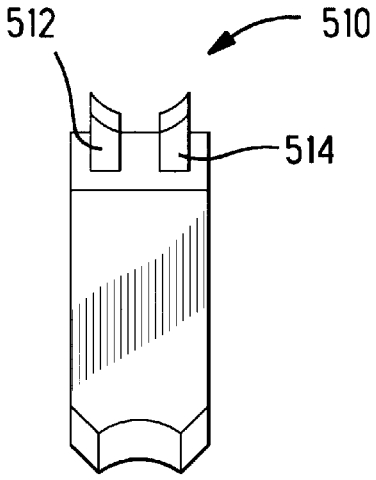
FIG. 25 is an end view of yet another embodiment of the wedge of the present invention.
Figure 26:
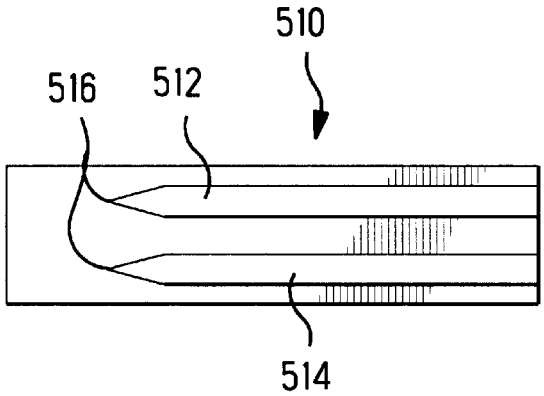
FIG. 26 is a side view of the wedge of FIG. 25.

FIG. 25 shows another embodiment, that is, a wedge 510 having features similar to those previously described with reference to FIGS. 3, 7 and 12, but having two side-by-side blades 512 and 514 that engage the insulated cables in unison and each has a sharp tip 516 that is more clearly shown in FIG. 26.

Figure 5:
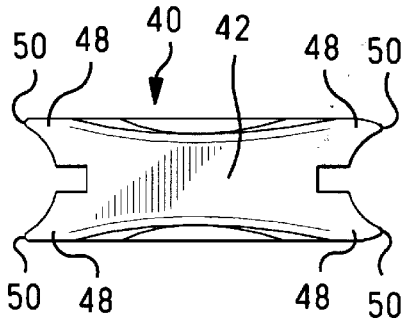
FIG. 5 is an end view of the wedge.
Figure 11:
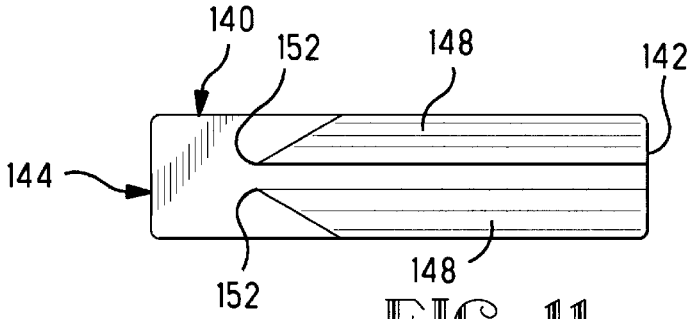
FIG. 11 is a side view of the wedge of FIG. 7 showing the blades.
Figure 9:
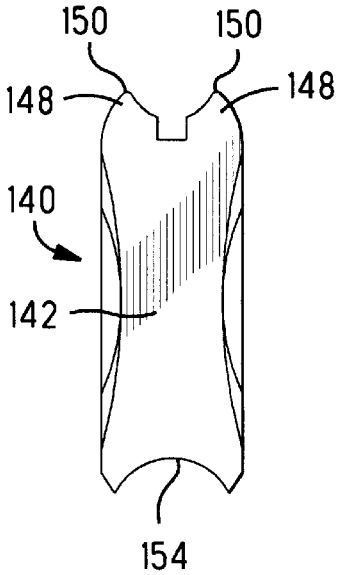
FIG. 9 is an end view of the wedge of FIG. 7.
Figure 10:
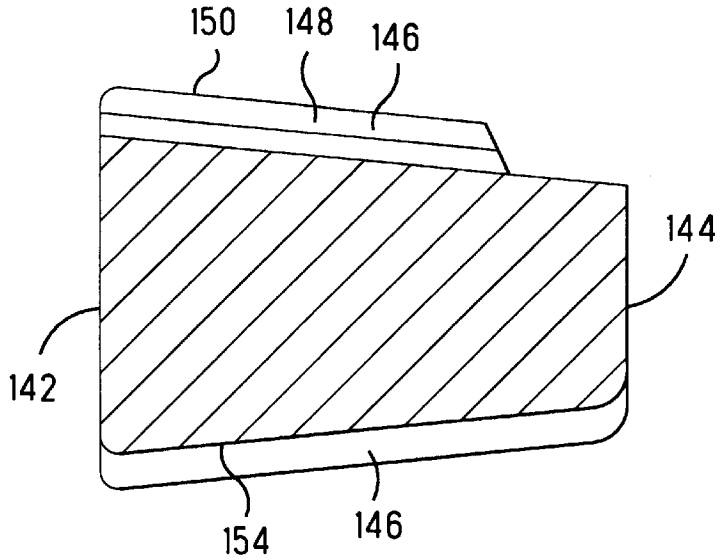
FIG. 10 is a front cross-sectional view of the wedge of FIG. 7.
Figure 14:
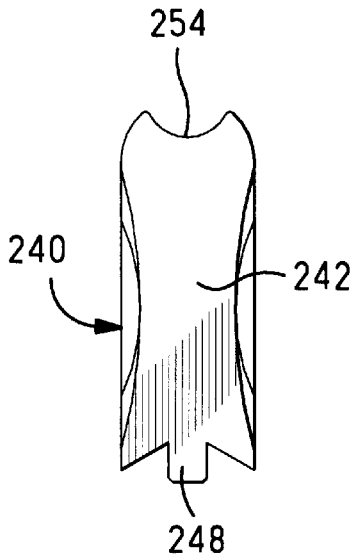
FIG. 14 is an end view of the wedge of FIG. 12.
Figure 15:
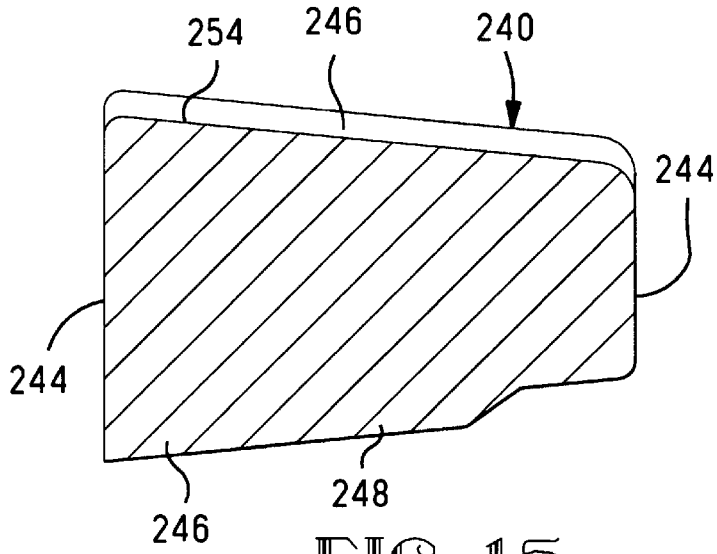
FIG. 15 is a front cross sectional view of the wedge of FIG. 12.
Figure 16:
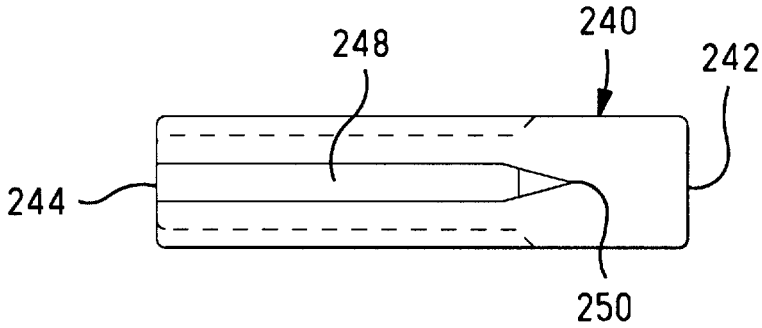
FIG. 16 is a side view of the wedge of FIG. 12 showing the blades.
Figure 27:
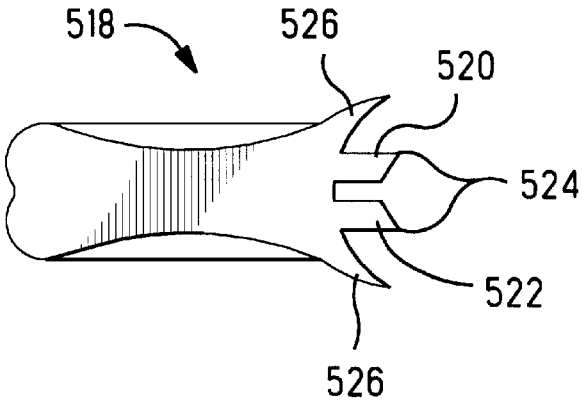
FIG. 27 is an end view of a further embodiment of the wedge of the present invention.

FIG. 27 shows another embodiment, that is, a wedge 518 having features similar to those previously described with reference to FIGS. 5, 9 and 14, but having blades 520 and 522, each having sharp tips 524, and centrally located relative to curved edge surfaces 526. The blades 520 and 522 act in a manner similar to blades 512 and 514 of FIG. 25, but are assisted by the curved edge surfaces 526 to find and engage the insulated cables.

The electrical connector of the present invention and many of its attendant advantages will be understood from the foregoing description. It is apparent that various changes may be made in the form, construction, and arrangement of parts thereof without departing from the spirit or scope of the invention, or sacrificing any of its advantages.

What is claimed is:

1. An electrical connector, comprising:

a C-shaped member having two ears with arcuate inner surfaces, at least one of the arcuate inner surfaces having teeth extending inwardly, at least one of the teeth having a plastic cap disposed thereover; and a wedge designed to be secured within the C-shaped member and terminated to cables therein, the wedge having two sides which cooperate with the arcuate inner surfaces to terminate the cables.

2. The electrical connector according to claim 1, wherein said C-shaped member has a forward end that first comes into contact with said wedge when said wedge is being secured within said C-shaped member and wherein said at least one of the teeth having said plastic cap is the first tooth at said forward end.

* * * * *